United States Patent [19]

Monacelli

[11] 4,148,425

[45] Apr. 10, 1979

[54] APPARATUS FOR DRIVING FIXING ELEMENTS, SUCH AS NAILS AND STAPLES, TO POSITIONS ACCESSIBLE WITH DIFFICULTY

[76] Inventor: Umberto Monacelli, Via Parini 6, Monza, Milan, Italy

[21] Appl. No.: 834,261

[22] Filed: Sep. 15, 1977

[30] Foreign Application Priority Data

Sep. 15, 1976 [IT] Italy ..... 22106 B/76

[51] Int. Cl.[2] ..... B25C 1/04

[52] U.S. Cl. ..... 227/130

[58] Field of Search ..... 227/109, 130

[56] References Cited

U.S. PATENT DOCUMENTS

| | | | |
|---|---|---|---|
| 221,785 | 11/1879 | Crisp | 227/130 |
| 2,995,113 | 8/1961 | Steiner | 227/130 |
| 3,035,268 | 5/1962 | Goldring | 227/130 |

*Primary Examiner*—Joseph H. McGlynn
*Assistant Examiner*—Paul A. Bell
*Attorney, Agent, or Firm*—Haseltine, Lake & Waters

[57] ABSTRACT

This invention relates to an apparatus for driving fasteners, such as nails and staples, which is able to work at positions accessible with difficulty. The apparatus of the present invention is accordingly provided with a firing nose, a jacket surrounding the pneumatic cylinder and a bracket connecting the actuating head to the casing member, which are connected to the remaining parts of the apparatus by removable means, which allow the replacement thereof with corresponding members of different length.

1 Claim, 1 Drawing Figure

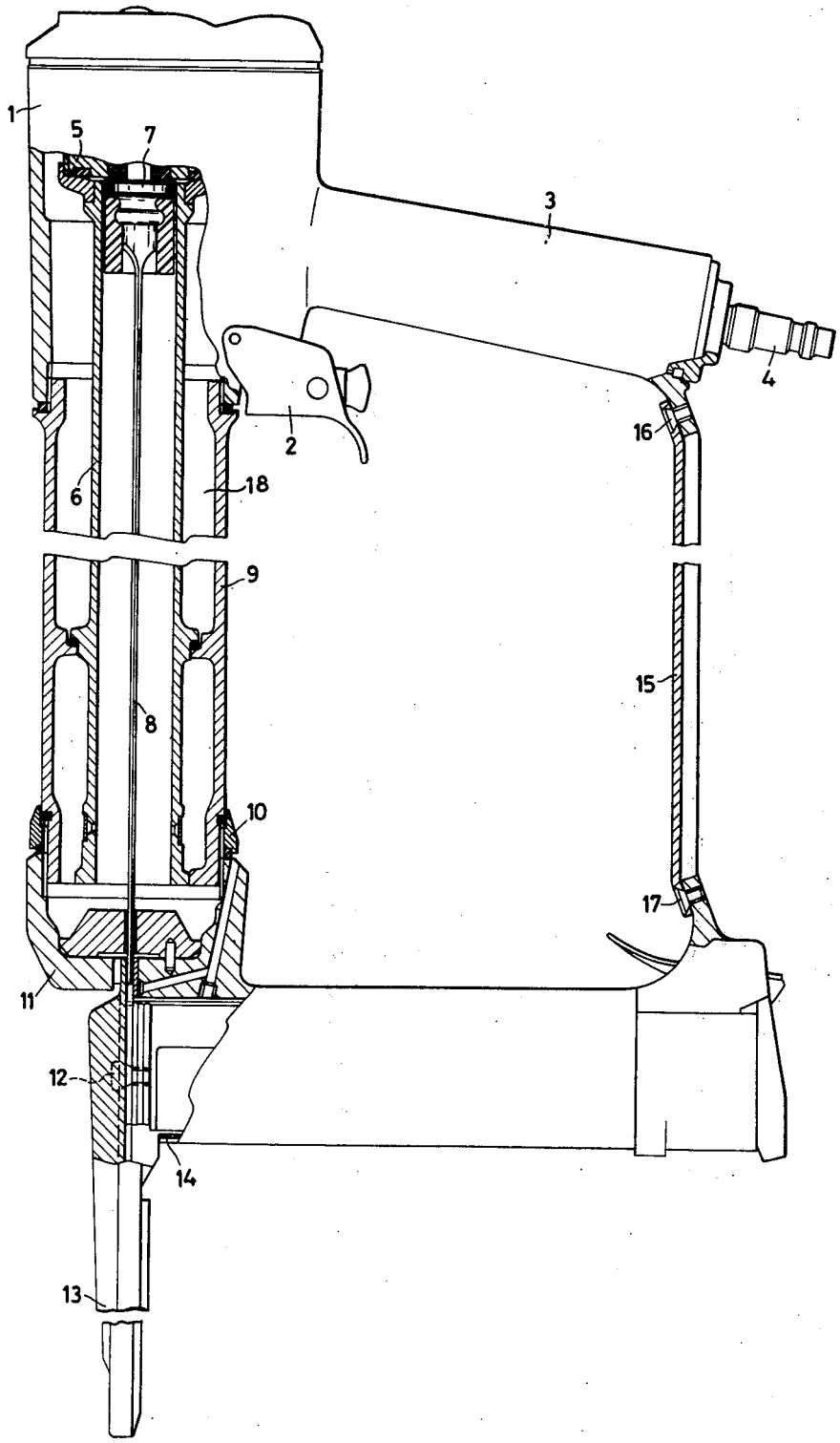
1
5
7
3
4
2
16
6
18
9
15
8
10
17
11
12
14
13

APPARATUS FOR DRIVING FIXING ELEMENTS, SUCH AS NAILS AND STAPLES, TO POSITIONS ACCESSIBLE WITH DIFFICULTY

The present invention relates to an apparatus for driving or inserting fixing elements, such as nails and staples, well suited for easy and quick fitting operations, which allows said apparatus to work at positions accessible with difficulty.

As it is known, conventional inserting apparatus generally comprise a pneumatic cylinder slidingly housing a piston carrying a hammer for inserting the fixing elements, a firing nose projecting from said cylinder to house and slidingly guide said hammer during the operating strokes of said piston, a casing member mechanically connecting said cylinder and firing nose, a fixing-element supplying magazine so supported by said casing member as to extend transversely from said firing nose, a pneumatic actuating head placed upon said cylinder, a compressed air tank transversely extending from said head, a cylindrical jacket coaxially placed about said cylinder to mechanically connect said head to said casing member and a bracket for mechanically connecting at the rear portions said tank and said casing member.

Also known are the troubles always encountered when such an apparatus is used for inserting fixing elements to positions accessible with difficulty, e.g. inside a high-shoulder shoe or high boot.

Therefore it is an object of the present invention to provide an apparatus of the aforesaid type, in which simple and quick fitting operations allow said apparatus to be well suited to work or operate at positions accessible with difficulty, particularly at positions of remarkable and variable depth.

According to the invention this object is achieved by an apparatus characterized in that the firing nose, the jacket about the cylinder and the bracket connecting the casing member and the tank are connected to the casing member, the actuating head and the tank by removable means allowing the replacement thereof and also of the hammer and cylinder by different-length corresponding elements.

It is evident that to each different length of said replaceable means a different length of the firing nose firstly corresponds, which allows the firing nose to wedge into positions more or less difficulty accesible, in particular into or more less deep positions, e.g. the inside of a shoes. As the length of the firing nose changes, naturally the hammer length must change, and then also that of the cylinder and so on. It is due to this fact that all the aforesaid elements are to be replaceable and then removably connected to the not replaceable elements.

The features and advantages of the present invention will become more apparent from the following detailed description of an embodiment thereof which as an example only is illustrated, partially with a section, in the sole FIGURE of the accompanying drawing.

The apparatus shown in the drawing comprises an actuating head 1, provided with a trigger 2, integral with a compressed air tank including fitting means 4 for an outer supply of compressed air.

From the actuating head 1, comprising in a known way an actuating valve 5, a cylinder 6 downwardly extends, in which a piston 7 is slidingly housed carrying a hammer 8.

The cylinder 6 is supported and enveloped by a cylindrical jacket 9, which has its threaded upper end screwed into the overhanging head 1 and its lower end, also threaded, screwed into and further locked by a ring nut 10 in an underlying casing member 11.

To this latter by means of a screw 12 a firing nose 13 is fixed, which extends as a projection of the cylinder 6 and houses and slidingly guides the hammer 8 during the operating strokes of the piston 7.

From the firing nose 13 a fixing element supplying magazine 14 transversely extends, which is supported by the casing member 11 extending in a similar manner.

The rear ends of the casing member 11 and the tank 3 are mechanically connected by a rigid bracket 15 provided with fixing screws 16 and 17.

It should be noted that the replacement of the different length firing nose 13 does not affect the safety of the appropriate operation of the apparatus due to the particular structure proposed by the invention. In fact in firing noses of greater length, a chamber 18 of greater volume is formed. As it is known this chamber represents the tank for the compressed air driving the stroke of the piston 7 which in turn controls the inserting operation: as the volume of the chamber 18 increases when the inner volume of the cylinder 6 increases, a constant and satisfactory driving or control characteristic of the stroke of the piston 7 is always assured.

The apparatus shown in the drawing, and after all that according to the invention, is generally provided for the use at positions of remarkable depth and then accessible with difficulty e.g. the inside of a boat.

Due to this reason, it is shown as provided with a firing nose which is much longer than a conventional one and with elements, such as the cylinder 6, the hammer 8, the jacket 9 and the bracket 15, which are of a correspondingly greater length.

However, it is possible to easily adapt the apparatus to operating places accessible with various difficulties, and particularly of different depth, replacing the firing nose 13 by one of different length and correspondingly replacing the cylinder 6, hammer 8, jacket 9 and bracket 15. This replacement is made possible and quick owing to the removable connection provided by the ring nut 10, the end thread of the jacket 9 and the screws 12, 16 and 17.

What we claim is:

1. An apparatus for driving fastners, such as nails and staples, into positions accessible with difficulty, comprising a pneumatic cylinder in which a piston carrying a hammer for inserting the fastners is slidingly housed, a nose lowerly projecting from said cylinder to house and slidingly guide said hammer during the operating strokes of said piston, a casing member mechanically connecting said cylinder and nose, a fastner supply magazine so supported by said casing member as to transversely extend from said hose, a pneumatic actuating head above said cylinder, a compressed air reservoir transversely extending from said head, a cylindrical jacket coaxially positioned about said cylinder to mechanically connect said head to said casing member and a bracket for mechanically connecting the rear portions of said reservoir and casing member, characterized in that said nose, said jacket and said bracket are connected to said casing member, said head and said reservoir by removable means allowing the replacement thereof and also of said cylinder and said hammer, by different length corresponding elements for quickly adapting the apparatus to working places of different accessibility and in particular of different depth.

* * * * *